US008219006B2

(12) United States Patent
Masui

(10) Patent No.: US 8,219,006 B2
(45) Date of Patent: Jul. 10, 2012

(54) IMAGE FORMING UNIT AND IMAGE FORMING APPARATUS HAVING THE SAME

(75) Inventor: Naoki Masui, Tokyo (JP)

(73) Assignee: Oki Data Corporation, Tokyo (JP)

( * ) Notice: Subject to any disclaimer, the term of this patent is extended or adjusted under 35 U.S.C. 154(b) by 253 days.

(21) Appl. No.: 12/690,310

(22) Filed: Jan. 20, 2010

(65) Prior Publication Data

US 2010/0196054 A1 Aug. 5, 2010

(30) Foreign Application Priority Data

Jan. 30, 2009 (JP) ..... 2009-019562

(51) Int. Cl.
*G03G 15/08* (2006.01)

(52) U.S. Cl. ..... 399/234

(58) Field of Classification Search ..... 399/234, 399/176, 274, 297
See application file for complete search history.

(56) References Cited

U.S. PATENT DOCUMENTS 5,089,851 A * 2/1992 Tanaka et al. ..... 399/176
2007/0242985 A1* 10/2007 Aoki et al. ..... 399/274

FOREIGN PATENT DOCUMENTS

| | | | |
|---|---|---|---|
| JP | 05-010395 | A | 1/1993 |
| JP | 06-075463 | A | 3/1994 |
| JP | 11-218983 | A | 8/1999 |
| JP | 2002-258719 | A | 9/2002 |
| JP | 2003-156986 | A | 5/2003 |
| JP | 2007-328097 | A | 12/2007 |
| JP | 2008-009077 | A | 1/2008 |

* cited by examiner

*Primary Examiner* — David Porta
*Assistant Examiner* — Faye Boosalis
(74) *Attorney, Agent, or Firm* — Kubotera & Associates, LLC

(57) ABSTRACT

An image forming unit includes an image supporting member; a developer supporting member for attaching developer to a static latent image formed on the image supporting member to form a developer image; and a protective sheet disposed between the image supporting member and the developer supporting member when the image forming unit is stored. The protective sheet has a surface resistivity between $1.0\times10^{8}\Omega/\square$ and $8.0\times10^{12}\Omega/\square$ when a voltage between 10 V and 250 V is applied thereto.

16 Claims, 4 Drawing Sheets

| | Surface resistivity [Ω/□] | | | | | | |
|---|---|---|---|---|---|---|---|
| Voltage [V] | A | B | C | D | E | F | G |
| 10 | 1.08E+11 | 5.36E+11 | 1.25E+12 | 1.38E+12 | 5.09E+12 | 8.00E+12 | 1.00E+13 |
| 100 | 2.88E+10 | 3.42E+10 | 3.91E+11 | 5.19E+11 | 2.00E+12 | 2.23E+12 | 1.00E+13 |
| 250 | 1.55E+10 | 1.60E+10 | 1.99E+11 | 3.41E+11 | 5.10E+11 | 1.35E+12 | 1.00E+13 |
| Result | ○ | ○ | ○ | ○ | ○ | ○ | × |

| | Surface roughness [Rz: μm] | | | | | |
|---|---|---|---|---|---|---|
| Surface resistivity [Ω/□] | 8 | 10 | 15 | 20 | 35 | 40 |
| $2.0 \times 10^{13}$ | △ | ○ | ○ | ○ | ○ | △ |
| $1.0 \times 10^{13}$ | × | △ | ○ | ○ | ○ | △ |
| $8.0 \times 10^{12}$ | × | △ | ○ | ○ | ○ | △ |

IMAGE FORMING UNIT AND IMAGE FORMING APPARATUS HAVING THE SAME

BACKGROUND OF THE INVENTION AND RELATED ART STATEMENT

The present invention relates to an image forming unit for supplying developer to a printer of an electro-photography type, a copier, and the like. The present invention also relates to an image forming apparatus having the image forming unit.

In a conventional image forming unit, a friction may be generated between a photosensitive drum and a developing roller during transportation thereof. Accordingly, when the conventional image forming unit forms an image for the first time after delivery, a density variance may occur due to insufficient charging.

In the conventional image forming unit, around the photosensitive drum having a surface with a static latent image to be formed thereon, there are provided a charging roller for uniformly charging the surface of the photosensitive drum, the developing roller for developing the static latent image with toner to form a toner image, and a cleaning roller for removing toner remaining on the surface of the photosensitive drum. The charging roller, the developing roller, and the cleaning roller are arranged to contact with the photosensitive drum.

In order to prevent the problem described above, when the conventional image forming unit is stored, a protective sheet is disposed between the photosensitive drum and the developing roller. The protective sheet has a three-layered structure formed of a urethane elastic sheet and a PET resin film attached to front and backside surfaces of the urethane elastic sheet. Accordingly, it is possible to prevent insufficient charging due to a stain on the surface of the photosensitive drum, thereby preventing a density variance such as a lateral streak after development (refer to Patent Reference).

Patent Reference: Japan Patent Publication No. 2003-156986

As described above, in the conventional image forming unit, the protective sheet includes the resin films formed of an insulation resin material and attached to the both sides of the elastic sheet. The photosensitive drum and the developing roller sandwich the protective sheet. Accordingly, when the protective sheet thus sandwiched is removed, frictional charging or separation charging occurs between the photosensitive drum and the developing roller. As a result, when the conventional image forming unit forms an image for the first time after delivery, a density variance such as a lateral streak may occur.

In view of the problems described above, an object of the present invention is to solve the problems of the conventional image forming unit, and to provide an image forming unit capable of reducing frictional charging and the like upon removing a protective sheet from the image forming unit, and reducing an image trouble when the image forming unit forms an image for the first time after delivery.

Further objects and advantages of the invention will be apparent from the following description of the invention.

SUMMARY OF THE INVENTION

In order to attain the objects described above, according to an aspect of the present invention, an image forming unit includes an image supporting member; a developer supporting member for attaching developer to a static latent image formed on the image supporting member to form a developer image; and a protective sheet disposed between the image supporting member and the developer supporting member when the image forming unit is stored. The protective sheet has a surface resistivity between $1.0\times10^{8}\Omega/\square$ and $8.0\times10^{12}\Omega/\square$ when a voltage between 10 V and 250 V is applied thereto.

In the aspect of the present invention, the image forming unit includes the protective sheet having the surface resistivity between $1.0\times10^{8}\Omega/\square$ and $8.0\times10^{12}\Omega/\square$ when the voltage between 10 V and 250 V is applied thereto. Accordingly, when the protective sheet is removed after delivery, it is possible to reduce an effect of frictional charging. As a result, when the image forming unit forms an image for the first time after delivery, it is possible to prevent an image trouble such as a lateral streak.

DETAILED DESCRIPTION OF THE PREFERRED EMBODIMENTS

Hereunder, embodiments of the present invention will be described in detail with reference to the accompanying drawings.

Embodiment

Figure 1:
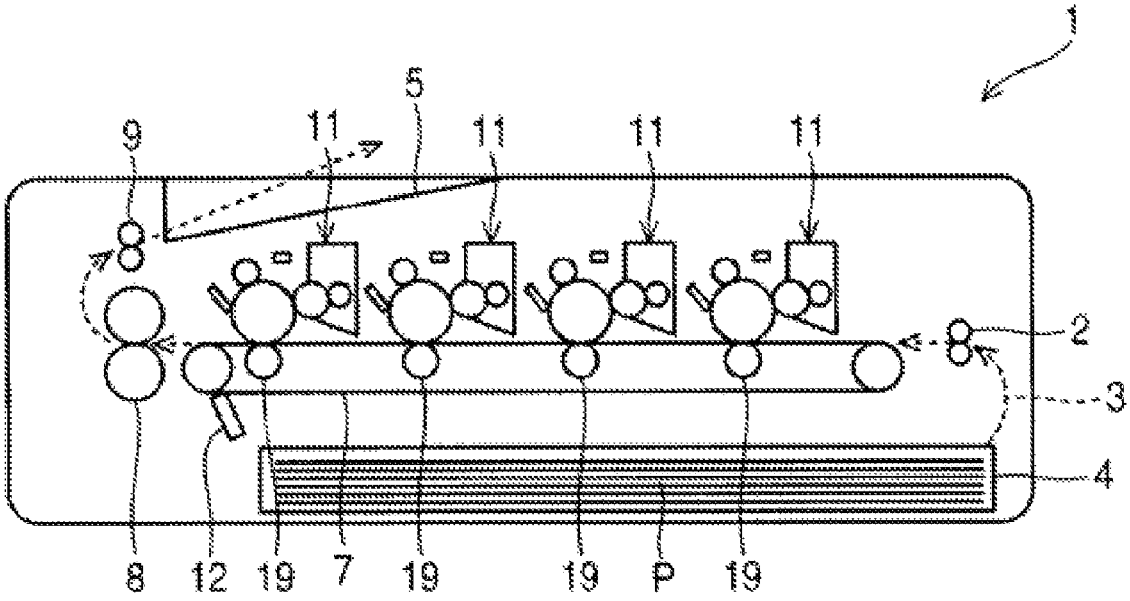
FIG. 1 is a schematic sectional view showing a printer according to an embodiment of the present invention.

An embodiment of the present invention will be explained. FIG. 1 is a schematic sectional view showing a printer 1 of an electro-photography type as an image forming apparatus according to the embodiment of the present invention.

As shown in FIG. 1, the printer 1 has a sheet transportation path 3 having a transportation roller 2, and the sheet transportation path 3 is formed in a substantially S character shape. A sheet cassette 4 is disposed at one end portion of the sheet transportation path 3 for retaining a sheet P as a print medium. A sheet discharge stage 5 is disposed at the other end portion of the sheet transportation path 3 for stacking the sheet P after an image is formed thereon. A transportation belt 7 is provided on the sheet transportation path 3 for transporting the sheet P through a static effect after the sheet P is transported one by one from the sheet cassette 4 to the sheet transportation path 3. Further, a fixing device 8 is provided on the sheet transportation path 3 for fixing the toner image on the sheet P through heat and pressure. Further, a discharge roller 9 is provided on the sheet transportation path 3 for discharging the sheet P to the sheet discharge stage 5 after the toner image is fixed.

In the embodiment, image forming units 11 are arranged to face the transportation belt 7 with the sheet transportation path 3 in between from an upstream side in a transportation direction of the sheet P in an order of forming the toner images. The image forming units 11 include toner cartridges 10 (refer to FIG. 2) as developer cartridges for retaining toner as developer in colors of K (black), Y (yellow), M (magenta) and C (cyan), respectively. Further, the printer 1 includes a cleaning blade 12 for removing toner remaining on the transportation belt 7.

Figure 2:
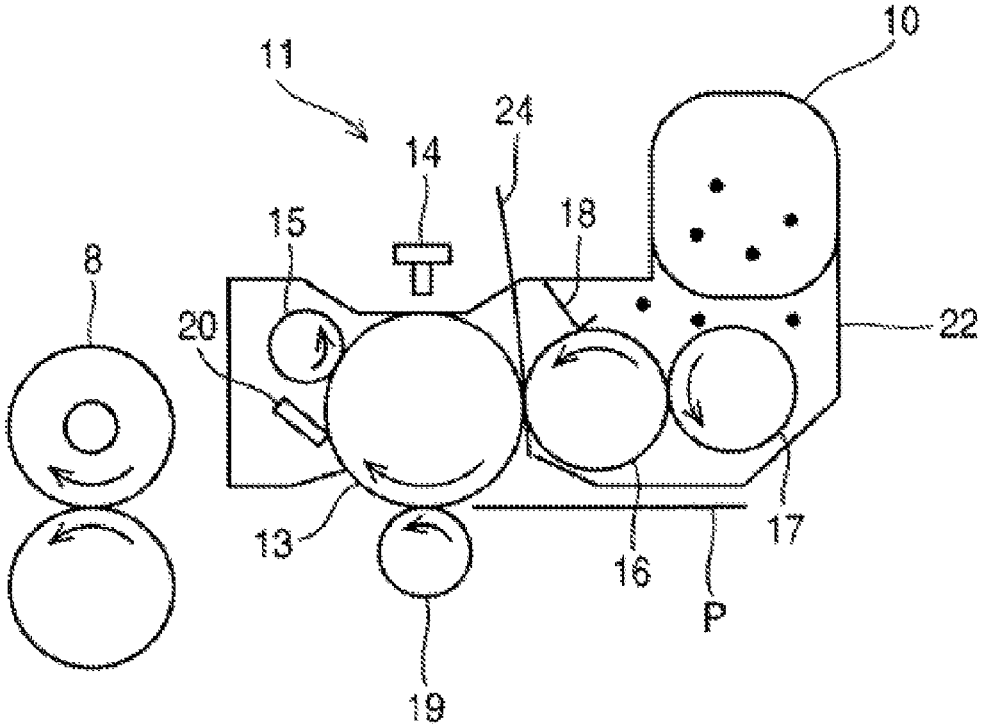
FIG. 2 is a schematic sectional view showing an image forming unit of the printer according to the embodiment of the present invention.

A configuration of the image forming units 11 will be explained next. FIG. 2 is a schematic sectional view showing the image forming unit 11 of the printer 1 according to the embodiment of the present invention.

As shown in FIG. 2, the image forming unit 11 includes a photosensitive drum 13 as an image supporting member. The photosensitive drum 13 is formed of a cylindrical body made of polycarbonate containing bisphenol-A with high wear resistance as a monomer. The photosensitive drum 13 is driven with a drive motor (not shown).

In the embodiment, the image forming unit 11 further includes an exposure head 14 as an exposure device. The exposure head 14 is formed of a plurality of light emitting elements such as LEDs (light Emitting Diodes) arranged in a main scanning direction. The exposure head 14 has a function of exposing the photosensitive drum 13 with light emitted from the light emitting elements to form a static latent image on the photosensitive drum 13.

In the embodiment, the image forming unit 11 further includes a charging roller 15 as a charging device. The charging roller 15 is formed of a metal shaft covered with a semi-conductive rubber layer. The charging roller 15 is arranged to rotate following a rotation of the photosensitive drum 13, so that the charging roller 15 uniformly charges a surface of the photosensitive drum 13.

In the embodiment, the image forming unit 11 further includes a developing roller 16 as a developer supporting member. The developing roller 16 is formed of polyurethane with conductivity made of a polyurethane base material containing a charging adjustment material such as carbon black and an amino silane modified with a polar group in a surface thereof. The developing roller 16 is arranged to contact with the photosensitive drum 13 and rotate in a direction opposite to that of the photosensitive drum 13. The developing roller 16 has a function of supplying toner to the static latent image on the photosensitive drum 13 formed with the exposure head 14, so that the static latent image is developed to form the toner image.

In the embodiment, the image forming unit 11 further includes a supply roller 17 as a developer supplying member. The supply roller 17 is formed of a metal shaft covered with a foamed rubber material such as a foamed urethane rubber. The supply roller 17 is arranged to contact and rotate together with the developing roller 16 in the same direction, so that the supply roller 17 supplies toner to the developing roller 16.

In the embodiment, the image forming unit 11 further includes a developing blade 18 as a developer regulating member. The developing blade 18 is formed of an elastic thin plate having a length in a longitudinal direction thereof substantially the same as a width of the polyurethane base material of the developing roller 16. The developing blade 18 is fixed to a frame 22 of the image forming unit 11 (described later) at one end portion thereof in the longitudinal direction. The other end portion of the developing blade 18 is arranged to slide against the developing roller 16 at a surface thereof slightly inside from a distal end portion thereof, so that the developing blade 18 regulates a thickness of toner at a specific level to be a thin layer, and charges toner through friction.

In the embodiment, the image forming unit 11 further includes a transfer roller 19 as a transfer member. The transfer roller 19 is arranged to face the photosensitive drum 13 with the sheet P in between, and is driven to rotate independently from the photosensitive drum 13. The transfer roller 19 has a function of transferring the toner image formed on the surface of the photosensitive drum 13 to the sheet P through an electric field generated with a voltage applied thereto.

In the embodiment, the image forming unit 11 further includes a cleaning device 20. the cleaning device 20 includes a cleaning blade made of polyurethane rubber and the like for scraping off and removing toner remaining on the surface of the photosensitive drum 13 after the toner image is transferred. As described above, the image forming unit 11 is formed of the photosensitive drum 13, the charging roller 15, the developing roller 16, and the supply roller 17.

In the embodiment, the image forming unit 11 further includes a protective sheet 24. The protective sheet 24 is formed of a sheet member made of polyolefin as a main raw material. The protective sheet 24 contains an antistatic agent such as lauryl tri-methyl ammonium chloride as a quaternary ammonium salt in a range between 0.5 weight % and 1 weight % to impart conductivity. A surface of the protective sheet 24 may be processed with corona discharge to become hydrophilic, thereby reducing a surface resistivity thereof.

In the embodiment, when the image forming unit 11 is manufactured, delivered, transported, or stored for a long period of time, the protective sheet 24 is disposed between photosensitive drum 13 and developing roller 16, so that photosensitive drum 13 and developing roller 16 sandwich the protective sheet 24 with elasticity thereof. Accordingly, the protective sheet 24 protects the surface of photosensitive drum 13 when the image forming unit 11 is stored.

In the embodiment, the protective sheet 24 may be formed of polyester or polystyrene as the main raw material. The protective sheet 24 may contain an antistatic agent such as an imidazoline-type dipolar surface acting agent calcium salt, an alanine-type dipolar surface acting agent, and a diamine-type dipolar surface acting agent. Further, the surface of the protective sheet 24 may be processed with acid or flame, thereby reducing the surface resistivity thereof.

In the embodiment described above, the present invention is applied to the printer 1 shown in FIG. 1 and the image forming unit 11 shown in FIG. 2. The present invention is not limited thereto, and may be applicable to the printer 1 having an intermediate transfer belt 30 for directly supporting the toner image visualized through developing. Further, the present invention may be applicable to a monochrome printer or a multi-color printer using toner in more than five colors.

An operation of the printer 1 will be explained next. As described above, when the image forming unit 11 is stored, the protective sheet 24 is inserted and disposed between photosensitive drum 13 and developing roller 16. When the image forming unit 11 is attached to the printer 1, the protective sheet 24 is removed from between the photosensitive drum 13 and the developing roller 16, so that the photosensitive drum 13 contacts with the developing roller 16, thereby making it possible to perform the developing process.

When an operator inputs print information to the printer 1, the print information is transmitted to a control unit (not shown) thereof. When the control unit receives the print information, the sheet P retained in the sheet cassette 4 is picked up and transported to the sheet transportation path 3. When the sheet P is transported to the sheet transportation path 3, the control unit controls the sheet transportation path 3 to transport the sheet P to each of the image forming units 11.

Further, when the control unit starts transporting the sheet P, the control unit controls a drive motor (not shown) to rotate the photosensitive drum 13 and the charging roller 15 of each of the image forming units 11. Accordingly, charging roller 15 charged with specific electron charges uniformly charges the photosensitive drum 13.

Then, the control unit generates print data corresponding to each color according to the print information, and sends the print data to the exposure head 14 of each of the image forming units 11. Accordingly, the exposure head 14 irradiates light to the surface of the photosensitive drum 13, so that the static latent image in each color is formed on the surface of the photosensitive drum 13.

Afterward, the developing roller 16 contacting with the photosensitive drum 13 to rotate attaches toner to the static latent image on the photosensitive drum 13 for developing the static latent image to form the toner image, and the transfer roller 19 sequentially transfers the toner image to the sheet P through the electric field, thereby forming an image on the sheet P. Then, the developing blade 18 fixes the image transferred to the sheet P, and the discharge roller 9 discharges the sheet P to the sheet discharge stage 5 of the printer 1 after the image is fixed.

As described above, in the embodiment, when the image forming unit 11 is stored, the protective sheet 24 is sandwiched between the photosensitive drum 13 and the developing roller 16, so that the frictional charging and the like are reduced when the protective sheet 24 is removed. Accordingly, a sheet property of the protective sheet 24 affects the charging property of the photosensitive drum 13. In particular, the sheet property affecting the charging property of the photosensitive drum 13 includes a surface resistivity, a surface roughness, and a tensional modulus of the protective sheet 24.

An experiment was conducted to optimize the sheet property of the protective sheet 24 as follows. First, an initial operation test of the printer 1 after delivery will be explained in a case of the protective sheet 24 with various levels of the surface resistivity.

Figures 3, 4:
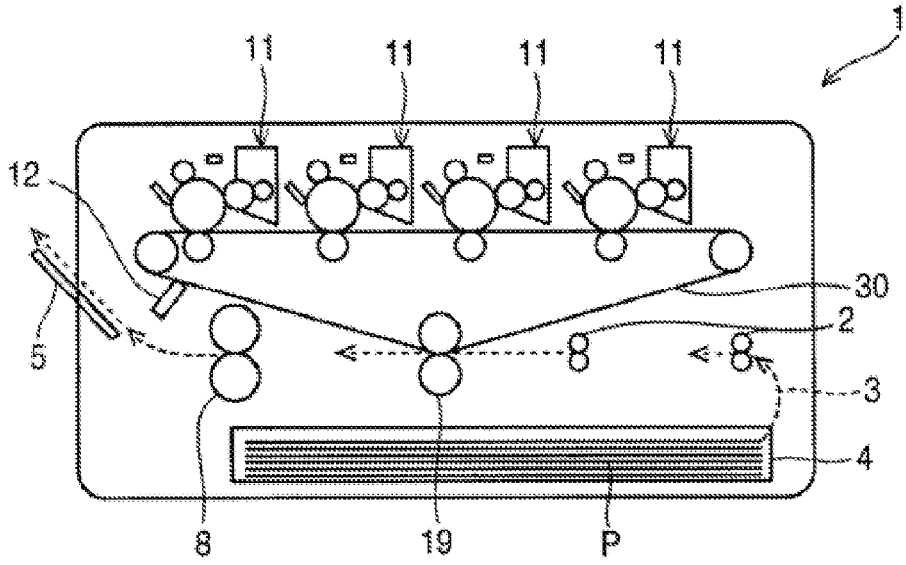
FIG. 3 is a schematic sectional view showing another type of the printer according to the embodiment of the present invention.
FIG. 4 is a table showing results of an initial operation test of the printer when protective sheets with various levels of surface resistivity are removed after delivery according to the embodiment of the present invention.
Figures 5, 6:
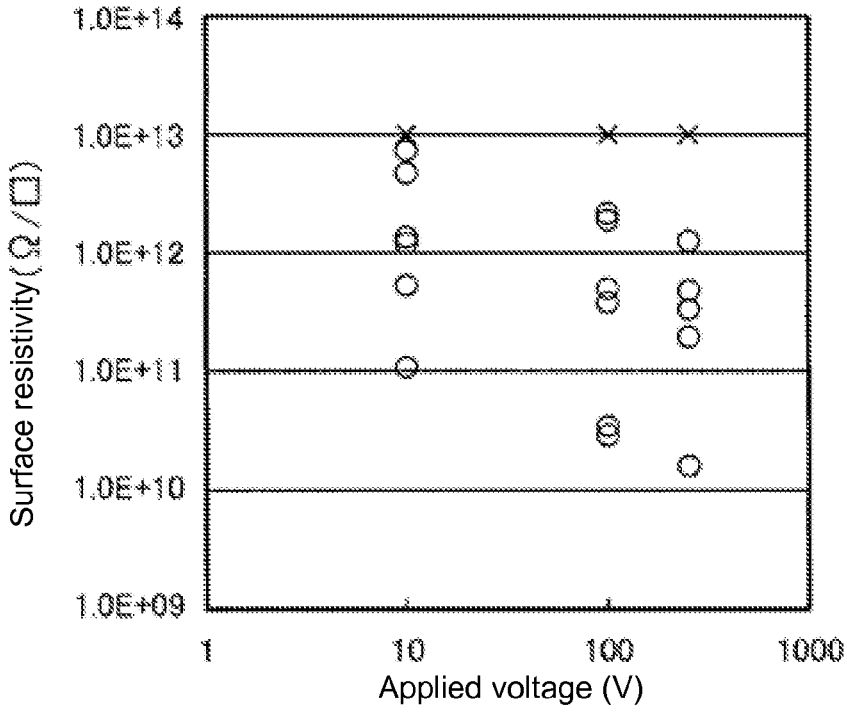
FIG. 5 is a graph showing the results of the initial operation test of the printer when the protective sheets with various levels of the surface resistivity are removed after delivery according to the embodiment of the present invention.
FIG. 6 is a table showing results of an initial operation test of the printer when protective sheets with various levels of surface roughness are removed after delivery according to the embodiment of the present invention.

FIG. 4 is a table showing results of the initial operation test of the printer 1 when the protective sheets 24 with various levels of the surface resistivity were removed after delivery according to the embodiment of the present invention. FIG. 5 is a graph showing the results of the initial operation test of the printer 1 when the protective sheets 24 with various levels of the surface resistivity were removed after delivery according to the embodiment of the present invention.

In the initial operation test of the printer 1, in the state that the protective sheet 24 was sandwiched between the photosensitive drum 13 and the developing roller 16, the image forming unit 11 was stored in a room environment (a temperature of 25° C., humidity of 55%) for seven days. Afterward, the protective sheet 24 was removed from the image forming unit 11, and the image forming unit 11 was attached to the printer 1. Then, the printer 1 formed an image on ten of the sheets P as an initial operation. The results show a relationship between the number of the sheets P with a lateral streak and the surface resistivity of the protective sheet 24.

In the experiment, among the ten of the sheets P, when no sheet had the lateral streak, an image evaluation was good and represented with "○". When more than one and less than five sheets had the lateral streak, the image evaluation was fair and represented with "Δ". When more than five sheets had the lateral streak, the image evaluation was poor and represented with "X".

In the experiment, the surface resistivity was measured using a resistivity meter Highrester UP (a product of Mitsubishi Chemical Corporation). More specifically, a UR-100 probe (a ring electrode: an outer diameter of 53.2 mm, an inner diameter of 50 mm) was attached to the resistivity meter, and an measurement was contacted on a stage made of poly tetrafluoroethylene at a temperature of 25° C. and humidity of 55% with applied voltages of 10 V, 100 V, and 250 V for 25 seconds.

In the embodiment, seven protective sheets A to G were processed as follows. The protective sheet A was processed with an antistatic agent A in a small amount. The protective sheet B was processed with the antistatic agent A in a large amount. The protective sheet C was processed with an antistatic agent B in a small amount. The protective sheet D was processed with the antistatic agent B in a large amount. The protective sheet E was processed with the antistatic agent B in a small amount and corona discharge to a small extent. The protective sheet F was processed with the corona discharge to a small extent. The protective sheet G was processed with the corona discharge to a large extent.

As shown in the table in FIG. 4, the protective sheet G exhibited the surface resistivity of $1.0\times10^{13}\Omega/\square$. When the protective sheet G was removed, the frictional charging was generated between the photosensitive drum 13 and the protective sheet 24, and was not dissipated. As a result, charges remained on the photosensitive drum 13, and more than five sheets had the lateral streak, thereby resulting in the poor result represented with "X".

Further, the protective sheets A to F exhibited the surface resistivity less than $8.0\times10^{12}\Omega/\square$. When each of the protective sheets A to F was removed, the frictional charging was generated between the photosensitive drum 13 and the protective sheet 24, and was dissipated. As a result, charges did not remain on photosensitive drum 13, and no sheet had the lateral streak, thereby resulting in the good result represented with "○".

As explained above, it is possible to prevent the charges from building up on the photosensitive drum 13 with the protective sheet 24 having the conductivity higher than that of the protective sheet G exhibiting the surface resistivity of $1.0\times10^{13}\Omega/\square$. When the antistatic agent is added, or the surface of the protective sheet 24 is processed, the antistatic agent or a processed portion of the protective sheet 24 contacts with atmospheric moisture, thereby providing conductivity. When the protective sheet 24 has the surface resistivity similar to that of a semiconductor ($1.0\times10^{-1}\Omega/\square$ to $1.0\times10^{7}\Omega/\square$), a frictional force between the protective sheet 24 and photosensitive drum 13 increases, thereby causing the frictional charging to a large extent. Further, when a conductive filler such as carbon black is added to the protective sheet 24, the surface of the protective sheet 24 has a larger rigidity, thereby making it easy to damage the photosensitive drum 13. Accordingly, it is preferred that the protective sheet 24 has the surface resistivity greater than $1.0\times10^{8}\Omega/\square$, i.e., a lower limit.

Next, the initial operation test of the printer 1 after delivery will be explained in a case of the protective sheet 24 with various levels of the surface roughness.

Figure 7:
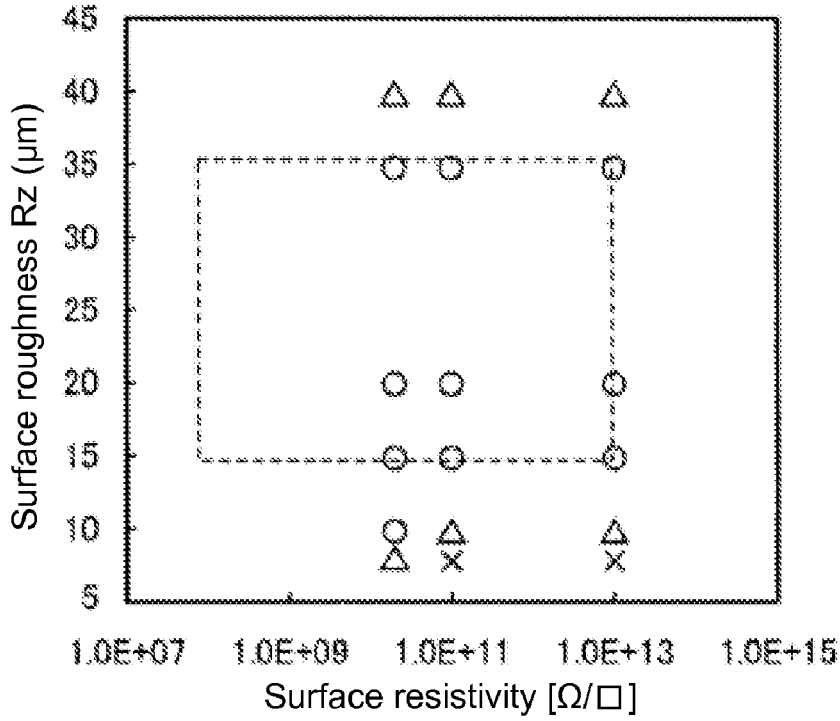
FIG. 7 is a graph showing the results of the initial operation test of the printer when the protective sheets with various levels of the surface roughness are removed after delivery according to the embodiment of the present invention.

FIG. 6 is a table showing results of the initial operation test of the printer 1 when the protective sheets 24 with various levels of the surface roughness were removed after delivery according to the embodiment of the present invention. FIG. 7 is a graph showing the results of the initial operation test of the printer 1 when the protective sheets 24 with various levels of the surface roughness were removed after delivery according to the embodiment of the present invention.

As described above, in the initial operation test of the printer 1, in the state that the protective sheet 24 with a different level of the surface roughness was sandwiched between the photosensitive drum 13 and the developing roller 16, the image forming unit 11 was stored in a room environment (a temperature of 25° C., humidity of 55%) for seven days. Afterward, the protective sheet 24 was removed from the image forming unit 11, and the image forming unit 11 was attached to the printer 1. Then, the printer 1 formed an image on ten of the sheets P as the initial operation. The results show a relationship between the number of the sheets P with a lateral streak and the surface resistivity of the protective sheet 24.

In the experiment, among the ten of the sheets P, when no sheet had the lateral streak, an image evaluation was good and represented with "○". When more than one and less than five sheets had the lateral streak, the image evaluation was fair and represented with "Δ". When more than five sheets had the lateral streak, the image evaluation was poor and represented with "X".

In the experiment, the surface roughness was measured using a laser microscope KV-9700 (a product of KEYENCE Corporation) in a measurement area of 0.373 $mm^2$, and the surface roughness was measured as a ten-point average roughness Rz through a calculation according to JIS 1994.

In the embodiment, the protective sheets 24 had three levels of the surface resistivity at the applied voltage of 10 V, i.e., $8.0\times10^{12}\Omega/\square$, $1.0\times10^{11}\Omega/\square$, and $2.0\times10^{10}\Omega/\square$, and had six levels of the surface roughness Rz, i.e., 8 μm, 10 μm, 15 μm, 20 μm, 35 μm, and 40 μm.

As shown in the table in FIG. 6, when the protective sheets 24 had the two levels of the surface resistivity, i.e., $8.0\times10^{12}\Omega/\square$ and $1.0\times10^{11}\Omega/\square$, the protective sheets 24 had the lateral streak when the surface roughness is less than 10 μm. When the protective sheet 24 the surface resistivity of $2.0\times10^{10}\Omega/\square$, the protective sheet 24 had the lateral streak when the surface roughness is less than 8 μm.

When the surface of the protective sheet 24 becomes smoother, the protective sheet 24 tends to contact with photosensitive drum 13 over a larger contact area. Accordingly, the charges are generated more dominantly through contact charging due to a charge row than the frictional charging. More specifically, when the photosensitive drum 13 formed of polycarbonate contacts with the protective sheet 24 formed of polyolefin or polyester, polycarbonate is charged positively and polyolefin or polyester is charged negatively, thereby causing the lateral streak in an image.

In the experiment, when the protective sheet 24 had the surface roughness of 40 μm, the surface of the photosensitive drum 13 was partially damaged due to friction with the protective sheet 24, thereby resulting in the fair result represented with "Δ".

As a summary of the results of the experiment described above, it is preferred that the protective sheet 24 has the sheet property within an area surrounded with a hidden line shown in FIG. 7. In the area, the protective sheet 24 has the surface resistivity between $1.0\times10^{8}\Omega/\square$ and $8.0\times10^{12}\Omega/\square$, and the surface roughness between 15 μm and 35 μm.

Even if the protective sheet 24 has the sheet property described above, when the protective sheet 24 formed of the polymer film contains an antistatic agent or an inorganic filler, a tension modulus thereof tends to decrease. Accordingly, when the protective sheet 24 sandwiched between the photosensitive drum 13 and the developing roller 16 is pulled out, the protective sheet 24 extends, thereby generating the frictional charging or damaging the photosensitive drum 13. As a result, when the printer 1 forms an image, the image may have a defect such as a lateral streak.

Figure 8:
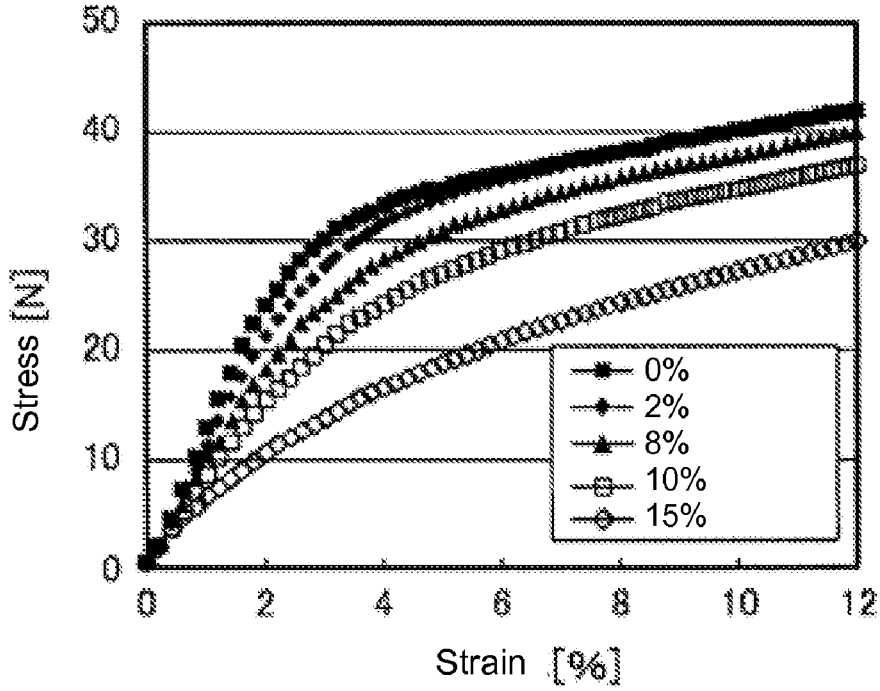
FIG. 8 is a graph showing stress-strain curves of protective sheets with various levels of tension modulus according to the embodiment of the present invention.

To this end, another experiment was conducted for evaluating the sheet property of the protective sheet 24. In the experiment, in the state that the protective sheet 24 with a different level of the tensional modulus was sandwiched between the photosensitive drum 13 and the developing roller 16, the image forming unit 11 was stored in a room environment (a temperature of 25° C., humidity of 55%) for seven days. Afterward, the protective sheet 24 was removed from the image forming unit 11, the protective sheet 24 was evaluated as a specimen. FIG. 8 is a graph showing stress-strain curves of the protective sheets 24 with various levels of the tension modulus according to the embodiment of the present invention.

In the experiment, the stress-strain curves were measured using a tension tester SV-201N (a product of Imada Seisakusho Co., Ltd.) at a temperature of 25° C., humidity of 55%, and a measurement speed of 10 mm/min. The specimen had a size according to Type 2 of JIS K 7127 (a length 150 mm, a width 25 mm, a thickness 45 μm). Five types of the protective sheet 24 containing the antistatic agent at an amount of 0%, 2%, 8%, 10%, and 15% were subject to the tensional test, and a strain of the stress-strain curve thus obtained at a stress of 30 N was evaluated.

As shown in FIG. 8, the protective sheet 24 containing the antistatic agent at an amount of 0% and 2% exhibited strains of 3.0% and 3.6% at the stress of 30 N, thereby showing substantially little extension. On the other hand, the protective sheet 24 containing the antistatic agent at an amount of 8%, 10, and 15% exhibited strains of 4.8%, 6.6% and 12% at the stress of 30 N, thereby showing gradual increase in extension. Calculated from an initial slope of the stress-strain curve, the protective sheet 24 containing the antistatic agent at an amount of 0%, 2%, 8%, 10%, and 15% exhibited the tensional modulus of 9.5 MPa, 8.2 MPa, 7.2 MPa, 6.1 MPa, and 4.4 MPa, respectively.

From the results of the experiment, from a view point of extension, it is preferred that the protective sheet 24 modified with the antistatic agent has the tensional modulus greater than 7.2 MPa, and an upper limit of the tensional modulus is preferred to be less than 12 MPa corresponding to a general level of polystyrene with high tensional modulus.

From the results of the experiments described above, it is preferred that the protective sheet 24 has the surface resistivity between $1.0\times10^{8}\Omega/\square$ and $8.0\times10^{12}\Omega/\square$, and the surface roughness between 15 μm and 35 μm. Further, it is preferred that the protective sheet 24 has the tensional modulus between 7.2 MPa and 12 MPa.

As described above, in the embodiment, the protective sheet 24 has the surface resistivity between $1.0\times10^{8}\Omega/\square$ and $8.0\times10^{12}\Omega/\square$ in the range of the applied voltage greater than 10 V and less than 250 V, and the surface roughness between 15 μm and 35 μm. When the image forming unit 11 is delivered, the protective sheet 24 is sandwiched between the photosensitive drum 13 and the developing roller 16. Accordingly, it is possible to prevent the surface of the photosensitive drum 13 from being damaged due to friction between the photosensitive drum 13 and the developing roller 16 during the transportation of the image forming unit 11. Further, it is possible to prevent the frictional charging as well.

Further, in the embodiment, when the protective sheet 24 is removed to contact the photosensitive drum 13 with the developing roller 16 after the delivery, it is possible to suppress the charging phenomenon due to the frictional charging, thereby making it possible to reduce an image trouble such as a lateral streak when the printer 1 forms an image for the first time.

Further, in the embodiment, the protective sheet 24 has the tensional modulus between 7.2 MPa and 12 MPa. Accordingly, when the protective sheet 24 is pulled out from between the photosensitive drum 13 and the developing roller 16, it is possible to reduce the charging phenomenon due to the frictional charging or the contact charging due to the extension of the protective sheet 24, thereby making it possible for the printer 1 to form a good image for the first time.

As described above, in the embodiment, the protective sheet 24 has the surface resistivity between $1.0\times10^{8}\Omega/\square$ and $8.0\times10^{12}\Omega/\square$ in the range of the applied voltage greater than 10 V and less than 250 V. When the image forming unit 11 is stored, the protective sheet 24 is sandwiched between the photosensitive drum 13 and the developing roller 16. when the protective sheet 24 is removed after the delivery, it is possible to suppress the charging phenomenon due to the frictional charging, thereby making it possible to reduce an image trouble such as a lateral streak when the printer 1 forms an image for the first time.

Further, in the embodiment, the protective sheet 24 has the surface roughness between 15 μm and 35 μm. Accordingly, it is possible to prevent the contact charging with the high flatness of the surface of the protective sheet 24. Further, it is possible to prevent the photosensitive drum 13 from being damaged due to friction between the protective sheet 24 and the photosensitive drum 13 as well, thereby making it possible to reduce an image trouble such as a lateral streak when the printer 1 forms an image for the first time.

Further, in the embodiment, the protective sheet 24 has the tensional modulus between 7.2 MPa and 12 MPa. Accordingly, when the protective sheet 24 is pulled out from between the photosensitive drum 13 and the developing roller 16, it is possible to reduce the charging phenomenon due to the frictional charging or the contact charging due to the extension of the protective sheet 24, thereby making it possible to reduce an image trouble such as a lateral streak when the printer 1 forms an image for the first time.

In the embodiment described above, the image forming apparatus is explained as the printer 1 of the electro-photography type, and may be an image forming apparatus using developer for a printer of an electro-photography type such as a copier.

The disclosure of Japanese Patent Application No. 2009-019562, filed on Jan. 30, 2009, is incorporated in the application by reference.

While the invention has been explained with reference to the specific embodiments of the invention, the explanation is illustrative and the invention is limited only by the appended claims.

What is claimed is:

1. An image forming unit, comprising:

an image supporting member;

a developer supporting member for attaching developer to a static latent image formed on the image supporting member to form a developer image; and a protective sheet inserted between the image supporting member and the developer supporting member when the image forming unit is stored, said protective sheet having a surface resistivity between $1.0\times10^{8}\Omega/cm^2$ and $8.0\times10^{12}\Omega/cm^2$ when a voltage between 10 V and 250 V is applied thereto.

2. The image forming unit according to claim 1, wherein said protective sheet has a surface roughness between 15 μm and 35 μm (according to JIS 1994).

3. The image forming unit according to claim 2, wherein said protective sheet has the surface resistivity between $2.0\times10^{10}\Omega/cm^2$ and $8.0\times10^{12}\Omega/cm^2$ when the voltage of 10 V is applied thereto.

4. The image forming unit according to claim 3, wherein said developer supporting member is formed of polycarbonate, and said protective sheet is formed of polyolefin or polyester so that the protective sheet is negatively charged through friction against polycarbonate.

5. The image forming unit according to claim 4, wherein said protective sheet contains an antistatic agent.

6. The image forming unit according to claim 5, wherein said protective sheet contains the antistatic agent including a quaternary ammonium salt, an imidazoline-type dipolar surface acting agent calcium salt, an alanine-type dipolar surface acting agent, and a diamine-type dipolar surface acting agent.

7. The image forming unit according to claim 5, wherein said protective sheet contains the antistatic agent including lauryl tri-'methyl ammonium chloride.

8. The image forming unit according to claim 4, wherein said protective sheet has a tensional modulus between 7.2 MPa and 12.0 MPa.

9. The image forming unit according to claim 1, wherein said protective sheet has a tensional modulus between 7.2 MPa and 12 MPa.

10. An image forming apparatus comprising the image forming unit according to claim 1.

11. The image forming unit according to claim 1, wherein said protective sheet has the surface resistivity between $2.0\times10^{10}\Omega/cm^2$ and $8.0\times10^{12}\Omega/cm^2$ when the voltage of 10 V is applied thereto.

12. The image forming unit according to claim 11, wherein said developer supporting member is formed of polycarbonate, and said protective sheet is formed of polyolefin or polyester so that the protective sheet is negatively charged through friction against polycarbonate.

13. The image forming unit according to claim 12, wherein said protective sheet contains an antistatic agent.

14. The image forming unit according to claim 13, wherein said protective sheet contains the antistatic agent including a quaternary ammonium salt, an imidazoline-type dipolar surface acting agent calcium salt, an alanine-type dipolar surface acting agent, and a diamine-type dipolar surface acting agent.

15. The image forming unit according to claim 13, wherein said protective sheet contains the antistatic agent including lauryl tri-methyl ammonium chloride.

16. The image forming unit according to claim 12, wherein said protective sheet has a tensional modulus between 7.2 MPa and 12.0 MPa.

* * * * *